United States Patent [19]

Mead et al.

[11] Patent Number: 4,504,376

[45] Date of Patent: Mar. 12, 1985

[54] UREA DEWAXING OF NAPHTHENE OILS

[75] Inventors: Theodore C. Mead, Port Neches; James H. Wright, Houston, both of Tex.

[73] Assignee: Texaco Inc., White Plains, N.Y.

[21] Appl. No.: 598,101

[22] Filed: Apr. 9, 1984

[51] Int. Cl.[3] ..... C10G 73/24

[52] U.S. Cl. ..... 208/25

[58] Field of Search ..... 208/25; 585/816, 817

[56] References Cited

U.S. PATENT DOCUMENTS

| | | | |
|---|---|---|---|
| 2,604,430 | 7/1952 | Skelton et al. | 208/25 |
| 2,889,260 | 6/1959 | Hoppe et al. | 208/25 |
| 2,913,390 | 11/1959 | Brunstrum | 208/25 |
| 3,071,534 | 1/1963 | Hoppe et al. | 208/25 |
| 3,132,084 | 5/1960 | Kerr et al. | 208/25 |
| 3,133,011 | 5/1964 | Franz et al. | 208/25 |
| 3,163,632 | 12/1964 | Leas et al. | 208/25 |
| 3,328,313 | 6/1967 | Dellow | 208/25 |
| 3,644,201 | 2/1972 | Van Paasen et al. | 208/25 X |
| 3,847,791 | 11/1974 | Kunert et al. | 208/25 |
| 3,945,912 | 3/1976 | Kunert et al. | 208/25 |

*Primary Examiner*—Delbert E. Gantz
*Assistant Examiner*—Glenn A. Caldarola
*Attorney, Agent, or Firm*—Jack H. Park; Kenneth R. Priem; Richard A. Morgan

[57] ABSTRACT

In an improved urea dewaxing process a urea/alcohol slurry chilled to 60° F. to 65° F. is added to a naphthenic distillate chilled to 60° F. to 65° F. to produce a refrigerator oil with improved low temperature properties.

6 Claims, 1 Drawing Figure

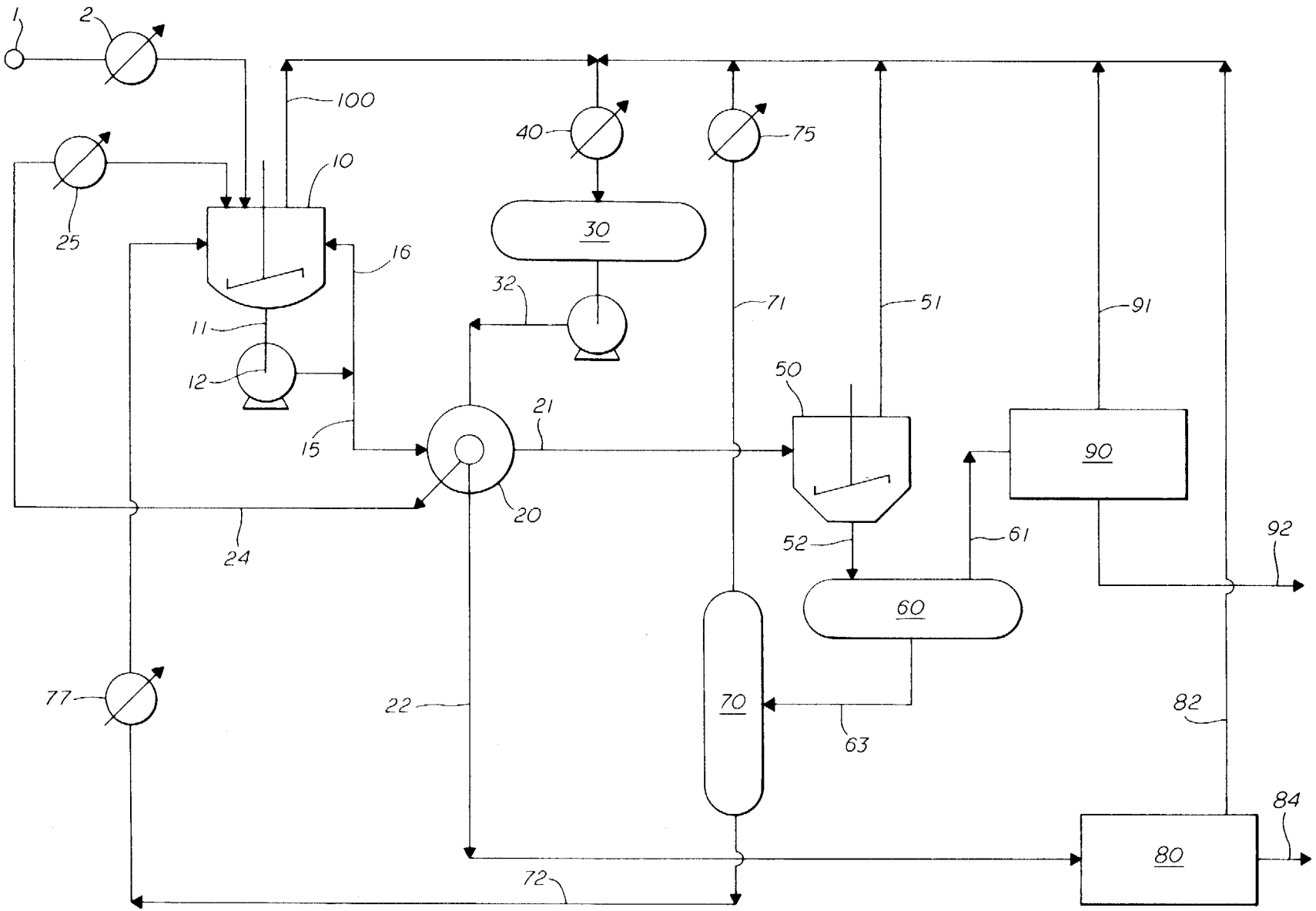
1
2
25
10
100
11
12
16
15
24
20
21
22
32
30
40
75
71
50
51
52
60
61
63
70
90
91
92
80
82
84
72
77

UREA DEWAXING OF NAPHTHENE OILS

BACKGROUND OF THE INVENTION

1. Field of the Invention

This invention relates to a process for preparing lubricating oils. More particularly it relates to an improved process for dewaxing refrigerator oils.

2. Description of the Prior Art

The invention relates to the urea-dewaxing of mineral oils containing very small amounts of n-paraffins. More particularly, the invention relates to the production of refrigerator oils from such low paraffin content mineral oils.

It is known to dewax hydrocarbon mixtures or mineral oil distillates by reacting them with urea to form solid adducts of the n-paraffins and separating these adducts from the dewaxed mineral oil. This process is called urea dewaxing and has been used in different embodiments for the large-scale refining of mineral oil. Usually in this process, the mineral oil distillate charge is diluted with urea dewaxing solvent, i.e., an organic solvent or mixture of solvents in order to reduce the viscosity of the reaction mixture, to improve its pumping and mixing properties, and to increase the degree of separation of the adduct and the dewaxing selectivity. In most cases, the same solvent, or solvent mixture, is used for washing the separated adducts and, if desired, for extracting the n-paraffins from the adduct. The solvent or solvent mixture, should not form adducts with urea under the reaction conditions being employed. Conventional solvents include lower aliphatic and aromatic hydrocarbons, chlorinated hydrocarbons such as, dichloromethane, and the like.

Usually, the urea is dissolved in water or methanol, the solution having been saturated at a temperature above the predetermined reaction or adduct-forming temperature. The amount of urea required for adduct formation is from 3.5 to 4 parts by weight per part by weight of n-paraffin to be separated from the mineral oil. It has also been proposed to use urea in crystalline form, preferably finely divided. In this case the formation of adduct progresses at a very slow rate, therefore usually minor amounts of activators such as water, methanol, ketones, and other urea-dissolving agent are added.

It is also known to initiate or accelerate the adduct-forming process by introducing a seed adduct. Another known method of enhancing the formation of adduct is by vigorously mixing the reaction mixture.

Refrigeration oils are used in the refrigeration and air conditioning industry to provide lubrication for refrigeration compressors. Two important characteristics of refrigeration oils are chemical and thermal stability. Chemical stability applies to chemical inertness to other system components at elevated temperatures as well as resistance to oxidation. These components include ammonia, sulfur dioxide, chlorinated hydrocarbons and the Freons, e.g., Freon 12 (dichloro-difluoro methane). Thermal stability refers to the resistance of the oil to degradation under thermal stress and thereby form deposits which coat heat exchanger surfaces or plug the expansion valve.

There is a need in the art for a processing sequence which affords a refrigeration oil with chemical and thermal stability. Production of such an oil is particularly difficult when the distillate oil charge stock comprises only minor amounts or just traces of n-paraffins.

It is the object of this invention to improve the urea dewaxing process so that very small amounts of n-paraffins contained in mineral oil distillate and similar hydrocarbon mixtures may be removed therefrom in a simple relatively rapid manner, and that the removal is practically complete and is preferably performed in a continuous operation. Another object is to produce a lubricating oil for refrigerating machines from a naphthenic mineral oil distillate.

In this regard, the present invention is an improvement in the art of urea dewaxing. Another contribution to the art of urea dewaxing is U.S. Pat. No. 3,945,912.

SUMMARY OF THE INVENTION

Refrigeration oils of superior Freon floc and haze points are produced from naphthenic lubricating oil distillate charge stocks by a urea dewaxing process. In a urea dewaxing process the distillate charge stock containing typically less than 2 wt% n-paraffin is mixed with an organic solvent and urea to form solid, n-paraffin-urea adducts. The adduct is separated from the dewaxed oil. Adduct is then decomposed or extracted and the urea recovered and recycled.

The present invention is an improvement in a urea dewaxing process wherein a naphthenic lubricating oil distillate charge stock is chilled to a temperature of 60° F. to 65° F. The organic solvent is then mixed with an excess of granulated urea to form a slurry and then also chilled to 60° F. to 65° F. The oil and slurry are vigorously mixed for 3 to 4 hours to form an n-paraffin-urea adduct. The dewaxed lubricating oil is then separated from the adduct.

BRIEF DESCRIPTION OF THE DRAWING

In the drawing is shown a urea dewaxing process.

DETAILED DESCRIPTION OF THE DRAWING

The drawing is taken substantially from *Hydrocarbon Processing,* September 1982, p. 196.

Naphthene distillate 1, optionally solvent refined and/or hydrogenated and/or acid treated is chilled in chiller 2 and introduced to stirred reactor 10. Chilled solvent and urea concentrate are already present in the stirred, reactor 10. An adduct rich slurry is formed in the reactor and a reactor bottoms stream 11 is pumped by pump 12 via reactor recycle 16 or in the alternative via filter charge 15 to rotating drum filter 20. Filtrate 22 is sent to solvent recovery section 80. Recovered solvent 82 is sent to solvent accumulator 30 through chiller 40. Dewaxed oil 84 is sent to a product accumulator (not shown).

Urea cake on filter 20 is washed with wash solvent 32 from the accumulator 30. Wash solvent is then chilled by means of chiller 25 and returned via line 24 to the reactor 10. Washed urea-adduct filter cake 21 is removed from the filter drum and sent to decomposer 50 wherein it is decomposed thermally or by other means. Recovered solvent 51 is returned to the solvent accumulator 30 via chiller 40.

Decomposer bottoms 52 is sent to a separator 60 where two layers form. The upper (solvent-paraffin) layer is sent via line 61 to a secondary solvent recovery section 90 wherein the higher boiling paraffin component (wax) is separated as bottoms 92 and sent to the wax accumulator (not shown). The lower (urea-solvent slurry) layer is drawn from the separator bottoms via line 63 and sent to concentrator 70. Concentrator overhead solvent 71 is chilled by chiller 75 and pumped to solvent accumulator 30 through chiller 40. Urea from the concentrate bottoms 72 is drawn off and chilled in chiller 77 before recycle to reactor 10. The wash solvent cycle is completed by removal of solvent from the reactor top via line 100 through chiller 40 to solvent accumulator 30.

DESCRIPTION OF THE PREFERRED EMBODIMENTS

The present invention is an improved process for the production of refrigerator oils of superior Freon floc and haze. These refrigerator oils are produced from naphthenic lubricating oil distillate charge stock which is characterized by typically containing less than 2 wt% normal paraffin. In a process for dewaxing, a naphthenic lubricating oil distillate charge stock comprising mixing the naphthenic oil with urea in the presence of an organic solvent and forming solid, n-paraffin-urea adducts, separating the adducts from the solution thereby producing dewaxed naphthenic oil, decomposing or extracting the separated adducts, recovering and recycling the urea and optionally, recovering the n-paraffins, the improvement which comprises:

a. chilling the naphthenic lubricating oil distillate charge stock to a temperature of 60° F. to 65° F.;
b. admixing granulated, solid urea with urea dewaxing solvent; the amount of urea being a multiple of the amount required for the complete conversion of the n-paraffin to n-paraffin-urea adduct; to form a slurry;
c. chilling the slurry to 60° F. to 65° F.;
d. vigorously mixing the naphthenic lubricating oil distillate charge stock with the slurry for 3 to 4 hours to form an n-paraffin-urea adduct;
e. separating from the mixture of step (d) a solids-free solution of dewaxed lubricating oil.

Naphthene specialty oils are prepared from distillates via a series of processing steps which may include acid treating, solvent extraction (with sulfur dioxide, phenol or furfural), hydrogenation, clay treatment and urea dewaxing. It is the urea dewaxing step which removes traces of paraffinic material; it is this paraffinic material which gives rise to Freon haze and floc. Urea is able to incorporate n-paraffins (which are of relatively small cross sectional area) into its crystal structure. Bulkier molecules, such as aromatics, naphthenes and isoparaffins are excluded for steric reasons.

The optimum temperature (criticality) for urea dewaxing naphthene oils was found experimentally. That there should be an experimentally recognizable optimum temperature was determined from the following discussion of system thermodynamics, kinetics and solubility.

It is known that urea reacts with paraffin to form adduct with the liberation of heat according to the reversible reaction:

$$(NH_2)_2C{=}O + \text{n-paraffin} \rightarrow \text{adduct} + \text{heat} \quad (1)$$

Increasing reaction temperature drives the reaction to the left. Therefore, thermodynamics favors lower temperature to enhance the formation of adduct. Higher temperature reduces the formation of adduct at equilibrium.

At initiation the only important reaction is the forward reaction, to the right. As this reaction proceeds, heat is formed thereby increasing temperature. The speed of the reaction to the right increases with temperature. Therefore, although low temperature establishes the most favorable equilibrium; high temperature gives better rate of adduct formation. Kinetic considerations oppose thermodynamic considerations.

In a two liquid phase system (oil-urea solution) in the presence of excess solid (urea), a complex solubility equilibria is established. To generalize, the solubility of urea in solution and the solubility of urea solution in oil increases with increased temperature. In the adduct forming reaction, urea taking part in the reaction is dissolved urea. It follows that for solubility considerations, higher temperature favors adduct formation.

When opposing thermal considerations exist in physical systems, maxima or minima may be found by plotting temperature against a product yield parameter. Such a procedure led to the discovery that 60° F. to 65° F. is the temperature range which is the best compromise among thermodynamic, kinetic and solubility constraints of the system.

Another discovery was the benefit derived from prechilling distillate and the urea-solvent mixture separately before mixing. As discussed hereinafter, a major mechanical problem in sub-ambient urea dewaxing is the tendency of urea to precipitate and cake upon heat exchanging surfaces. This tendency is exacerbated if either stream is brought into the reactor at an elevated temperature and the resultant mixture cooled. Under these conditions urea becomes less soluble in the reaction medium and preferentially nucleates upon reactor walls rather than in the mass of the solution proper. This caking tendency is lessened by prechilling the liquids separately before the adduction reaction commences; and then subjecting the mixture to violent agitation.

As stated, adduct formation proceeds with the generation of heat. We have experimentally found that n-paraffin is more efficiently removed at low temperature. Our efforts to exploit this temperature effect at temperatures lower than ambient temperature (65° F.) were at first unsuccessful. When urea and alcohol were added to oil chilled to 65° F., urea rapidly caked on the cooling surfaces of the reactor, and dewaxing was less effective than that at ambient temperature.

The procedure was then modified by subjecting the urea to premixing with the alcohol mixture with violent agitation. Despite the fact that complete solution of urea in alcohol was not obtained, addition of the chilled suspension to chilled oil surprisingly gave significantly improved low temperature properties to product oil. This is seen in Example 1, Table 1. It was noted that urea did not cake on cooled reactor parts when chilled dissolved urea was added to chilled oil.

Intermediate naphthenic petroleum distillate oil stocks are the charge stocks which have been dewaxed according to the present invention to produce refrigerator oil. These stocks are characterized as containing less than 2 wt% n-paraffins, particularly less than 1 wt%. The present process is effective where the feedstock contains less than 0.5 wt% n-paraffin. Such intermediate naphthenic petroleum distillate oil stocks have a viscosity in the range of about 50 to 650 SUS at 100° F. and boil in the range of about 625° F. initial boiling point to about 1100° F. end point. Such intermediate naphthenic petroleum distillate oil stocks may be derived from the raw lube oil stocks, the major portion of which boil above 650° F. Such raw lube stocks can be vacuum distilled with overhead and side draw distillate streams and a bottom stream referred to as residual oil stock. Considerable overlap in boiling ranges of distillate streams and the residual stream may exist, depending upon distillation efficiency. Some heavier distillates have almost the same distribution of molecular species as the residual stream.

Such distillate streams contain aromatic and polar compounds which are undesirable in lubricating oils. Such compounds are removed, by means such as solvent extraction and hydrogenation. Pour point is the temperature at which oil will cease to flow when chilled under prescribed conditions.

Urea dewaxing organic solvent is typically a mixture of activator and diluent solvents. The organic solvent added to the oil distillate feed should not form an adduct with urea, and should have a density substantially below the n-paraffin urea adduct. Useful activators include lower aliphatic hydrocarbons, such as pentane, hexane and and heptane; lower alcohols, such as methanol and isopropanol; ketones, such as butanone and methylisobutylketone; halogenated hydrocarbons such as, dichloromethane and dichloroethane and water. Mixtures of these solvents may also be employed. Diluents include aromatic hydrocarbons such as benzene, toluene, cyclohexane and mixtures thereof. In particular it was found that suitable solvents for performing the improved dewaxing process according to the invention percent of a hydrocarbon having from 5 to 7 carbon atoms such as hexane or, preferably, benzene and from about 5 to 60 volume percent of methylisobutylketone. The mineral oil charge is diluted with 30 to 80 parts by volume, more particularly 40 to 60 parts by volume, of this solvent mixture, per 100 parts by volume of mineral oil distillate but higher concentrations of solvent also are acceptable.

In this process, to effectively remove the small quantity of n-paraffins present, large excesses of the stoichiometric quantity of urea required for adduct formation are required. For adduct formation 3.5 to 4 parts by weight of urea per part by weight of n-paraffin are required. In our process up to 20 times or more, preferably up to 10 times the amount required for complete conversion of n-paraffins into solid adduct is used.

This process finds particular utility in dewaxing naphthenic base distillate oils to produce refrigerator oils. Refrigerator oils usually are prepared from isoparaffinic products obtained from a hydrocracking process or preferably from naphthenic base distillates. These starting materials already have low pour points, ranging from about minus 30° C. to minus 50° C. or lower, but nevertheless contain minor amounts of n-paraffins which must be removed therefrom completely or at least to a large extent since they may cause haziness or flocculation. These oils may be tested for haziness or flocculation in the Freon flocculation test according to German Standard DIN No. 51351 and DIN 51590. A refrigerator oil which is to be employed in refrigerators operated on $CF_2Cl_2$ (Freon 12) should have a Freon cloud point or flock point of at least about minus 55° C. Freon is a registered trademark for a series of halogenated hydrocarbon refrigerants.

In the production of low Freon haze refrigerator oils the recovery of normal aliphatic constituents from the complex is not of immediate concern since the production of products which meet test specifications is of paramount importance. However, in order to provide a continuous process, it is necessary to decompose the complex into urea and normal aliphatic constituents and reuse the urea for contacting of more charge oil. The improvement of this invention is independent of the means used to decompose the complex and provide a continuous process. However, a brief discussion of the means of decomposition will be presented from which it will be obvious to one skilled in the art how the process of the subject application can be adapted to continuous operation.

The separated solid phase consisting of complex and excess urea can be treated with an aromatic hydrocarbon solvent such as benzene or with a low molecular weight aliphatic hydrocarbon such as pentane which does not complex at atmospheric conditions with urea whereby the complex-forming components of the complex are liberated from the complex and are dissolved in the solvent; the urea portion of the complex and the urea portion of the solid phase are left in the solid state by this treatment. The solution of liberated complex-forming constituents can be readily separated from the solid urea and the complex-forming constituents recovered from the solvent by fractional distillation. Temperatures of 100° F. to 180° F. are recommended for this treatment. The residual solid urea can be slurried with further quantities of alcohol and used to contact further portions of organic mixture.

Another procedure for decomposing the complex involves treating the mixture of complex and excess urea with a hydrocarbon-immiscible urea solvent such as water or methanol, whereby the complex is decomposed with dissolution of urea in the urea solvent. The liberated complex-forming constituents are readily separated from the urea solution in which they are substantially insoluble. Water and low molecular weight alcohols are examples of solvents that may be employed. Temperatures between about 120° F. and 200° F. are employed in this procedure. This method of decomposition necessitates recovery of solid urea from solution in order to prepare the urea slurry reagant.

The present invention is better shown by way of example:

EXAMPLE 1

A distillate from a Class B naphthene Cabimas crude was subjected to acid treating and sulfur dioxide extraction at conditions known to the art. The refined oil (13,250 g) of 53.28 cSt viscosity at 40° C. was chilled to 65° F. and maintained at that temperature. In a separate vessel, methanol (98 cc), isopropanol (196 cc) and urea (189 g) were mixed with agitation. (Note: This step may be done at elevated temperature if needed for complete dissolution. Temperature must, however, be reduced before the urea solution is added to chilled oil.) The resulting alcohol-urea slurry, which contains a substantial proportion of dissolved urea was chilled to 65° F. and added to the chilled oil and the oil-urea-alcohol mixture agitated via a circulating pump for four hours.

Solid urea was filtered from the mixture at 65° F. After this point it was no longer necessary to maintain sub-ambient temperatures. The oil was washed free of alcohol with two five-gallon portions of water at 120°–140° F. and brightened with nitrogen at 165° for 1 hour. Properties of the brightened oil are those listed in Column C of Table I.

TABLE I

| LOW TEMPERATURE PROPERTIES OF DEWAXED OILS | | | | |
|---|---|---|---|---|
| OIL | A | B | C | D |
| FREON FLOC, | −20° F. | −45° F. | −70° F.* | −65° F. |

TABLE I-continued

| LOW TEMPERATURE PROPERTIES OF DEWAXED OILS | | | | |
|---|---|---|---|---|
| OIL | A | B | C | D |
| (T.T.C. Method No. ST-177-55) | | | | |
| FREON HAZE, (T.T.C. Method No. ST-177-55) | −20° F. | −25° F. | −60° F.* | −45° F. |
| POUR, °F. (ASTM D-97-66) | −25° F. | −30° F. | −60° F. | −40° F. |

A Sulfur dioxide refined, acid treated Grade B distillate.
B "A" urea dewaxed without chilled alcohol-urea presolution.
C "A" urea dewaxed according to illustrative example.
D Typical values for urea dewaxed Grade A naphthene oil without alcohol-urea presolution.
*Duplicate analyses.

EXAMPLE 2

Attention is drawn to the drawing by way of example. Chillers 25, 40, 75 and 77 maintain a solvent and urea temperature of 63° F. in the reactor. An intermediate naphthenic petroleum distillate oil stock is chilled to 63° F. in chiller 2 before charging to the reactor 10. The reactor is stirred and also vigorously mixed by means of a bottoms pump 12 and recycle line 16. After 3½ hours of vigorous mixing, the filter feed line 15 is opened and the recycle line 16 closed. Wax is separated from oil in the filter and a good quality transformer oil produced thereby.

The principle of the invention and the best mode contemplated for applying the principle have been described. It is to be understood that the foregoing is illustrative only and that other means and techniques can be employed without departing from the true scope of the invention defined in the following claims.

What is claimed is:

1. In a process for dewaxing a naphthenic lubricating oil distillate charge stock containing less than 2 wt% n-paraffin the process comprising mixing the naphthenic oil with urea in the presence of an organic solvent and forming solid, n-paraffin-urea adducts, separating the adducts from the solution thereby producing dewaxed naphthenic oil, decomposing or extracting the separated adducts, recovering and recycling the urea and optionally, recovering the n-paraffins, the improvement which comprises:

a. chilling the naphthenic lubricating oil distillate charge stock to a temperature of 60° F. to 65° F.;

b. admixing granulated, solid urea with urea dewaxing solvent, the amount of urea being a multiple of the amount required for the complete conversion of the n-paraffin to n-paraffin-urea adduct; to form a slurry;

c. chilling the slurry to 60° F. to 65° F.;

d. vigorously mixing the naphthenic lubricating oil distillate charge stock with the slurry for 3 to 4 hours to form an n-paraffin-urea adduct;

e. separating from the mixture of step (d) a solids-free solution of dewaxed lubricating oil.

2. The process of claim 1 wherein vigorous mixing is achieved by continuously pumping and thereby circulating the mixture in a closed loop.

3. The process of claim 1 wherein the amount of urea added is 3.5 to 4 parts by weight per part by weight of n-paraffin to be separated from the distillate charge stock.

4. The process of claim 1 wherein the amount of urea added is up to 10 times the parts by weight of n-paraffin to be separated.

5. The process of claim 1 wherein the charge stock contains less than 1 wt% n-paraffin.

6. The process of claim 1 wherein the charge stock contains less than 0.5 wt% n-paraffin.

* * * * *